US012312741B2

(12) United States Patent
Doona et al.

(10) Patent No.: US 12,312,741 B2
(45) Date of Patent: May 27, 2025

(54) PROCESS FOR DYEING HIGH-PERFORMANCE TEXTILES

(71) Applicant: Government of the United States as Represented by the Secretary of the Army, Natick, MA (US)

(72) Inventors: Christopher Doona, Marlborough, MA (US); Richard Liu, Belmont, MA (US); Timothy Swager, Newton, MA (US)

( * ) Notice: Subject to any disclaimer, the term of this patent is extended or adjusted under 35 U.S.C. 154(b) by 0 days.

(21) Appl. No.: 18/600,861

(22) Filed: Mar. 11, 2024

(65) Prior Publication Data

US 2025/0066997 A1 Feb. 27, 2025

Related U.S. Application Data

(60) Provisional application No. 63/534,191, filed on Aug. 23, 2023.

(51) Int. Cl.

| | |
|---|---|
| ***D06P 1/00*** | (2006.01) |
| ***D02G 3/02*** | (2006.01) |
| ***D06P 1/384*** | (2006.01) |

(52) U.S. Cl.

CPC ..... *D06P 1/384* (2013.01); *D02G 3/02* (2013.01); *D10B 2331/021* (2013.01); *D10B 2401/14* (2013.01)

(58) Field of Classification Search

CPC ..... D06P 1/384; D02G 3/02; D10B 2331/021; D10B 2401/14

USPC ..... 8/444

See application file for complete search history.

(56) References Cited

FOREIGN PATENT DOCUMENTS

| | | | | |
|---|---|---|---|---|
| CN | 112522975 A * | 3/2021 | ..... | D06P 5/22 |
| WO | WO 2023060346 A1 * | 4/2023 | ..... | C06D 163/00 |

OTHER PUBLICATIONS

STIC Search Report dated Mar. 13, 2025.*

* cited by examiner

*Primary Examiner* — Eisa B Elhilo
(74) *Attorney, Agent, or Firm* — Timothy M. Barlow

(57) ABSTRACT

The present disclosure relates to methods and compositions used therein to dye via a bifunctional diazirene compound high-performance textiles including para-aramid (polymers of co-polymers), ultra-high molecular weight polyethylene (UHMWPE), or nylon as filament yarns and/or spun yarns of fibers or fiber-blends thereof and in a manner more quickly and more environmentally friendly.

15 Claims, 6 Drawing Sheets

PROCESS FOR DYEING HIGH-PERFORMANCE TEXTILES

CROSS-REFERENCE TO RELATED APPLICATIONS

This application claims the benefit of U.S. Provisional Application No. 63/534,191 filed on 23 Aug. 2023, the contents of which, in its entirety, is herein incorporated by reference.

STATEMENT OF GOVERNMENT INTEREST

The invention described herein may be manufactured and used by the United States Government for governmental purposes without the payment of any royalty thercon.

FIELD

The aspects of the present disclosure relate to methods and compositions used therein to dye fabrics.

BACKGROUND

Para-aramids and ultra-high molecular weight polyethylene (UHMWPE) are lightweight, high-strength, high-performance materials that appear under the common trade names Kevlar®, Twaron®, Spectra®, or Dyneema® and have been used in diverse applications, such as ropes, cables, tires, cut-resistant gloves, sportswear and athletic apparel, firefighter gear, and various types of law enforcement and military tactical gear related to ballistics and blast protection (e.g., vests, body armor, face masks, helmets, camouflage-printed flame resistant uniform fabrics, and protective undergarments for blast events). Para-aramids and UHMWPE are chemically inert, which makes high-performance textiles constructed with these fibers and/or yarns resistant to dyeing/printing by conventional processes. It is a challenge to implement p-aramid and/or UHMWPE as filaments, fibers, yarns, and textiles in some protective outerwear applications, particularly those that require multi-colored camouflage patterns suitable for different operational environments.

The present disclosure includes a bifunctional diazirene compound to dye protective fabrics made with the high-performance materials para-aramid, UHMWPE, or nylon (e.g., Cordura) as filaments or fiber blends thereof through chemical synthesis strategies that take substantially less time (<2 h), eliminate the use of toxic mercury or other metals, and are more environmentally-friendly than other dye processes. The present diazirine method dyes high-performance textiles made with para-aramid, UHMWPE, or nylon without compromising the strength or material properties of the fibers or fabrics, such that para-aramids and UHMWPE will have more potential uses in a broader range of protective outerwear applications, including those that require camouflage patterns suitable for different operational environments.

DESCRIPTION OF THE DRAWINGS

The accompanying drawings illustrate presently preferred embodiments of the present disclosure, and together with the general description given above and the detailed description given below, serve to explain the principles of the present disclosure and are in no way limiting.

SUMMARY

Figure 1:
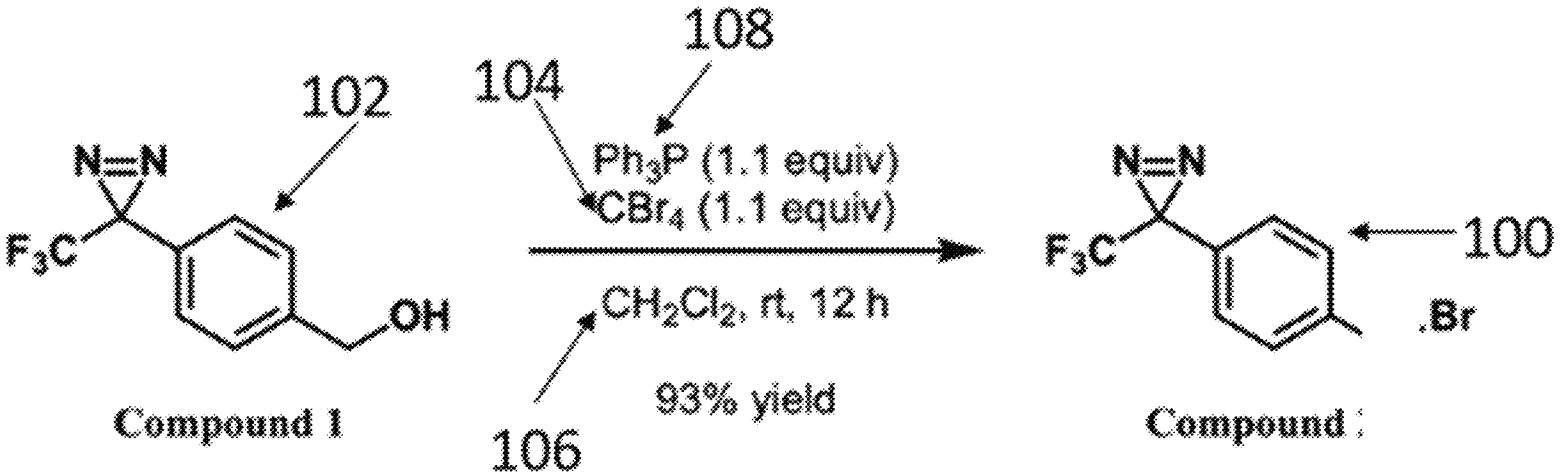
FIG. 1 illustrates an embodiment of the present disclosure: the bifunctional diazirene molecule 4-[3-(Trifluoromethyl)-3H-diazirin-3-yl]benzyl bromide can be prepared and covalently attached to fabrics through one terminus, to serve as an "anchor" molecule for subsequently binding dye molecules through the second terminus.

In one embodiment, a method of dyeing textiles including surface functionalization with a carbene-based molecule is provided. The method includes reacting the textile with a bifunctional diazirene reagent 4-[3-(Trifluoromethyl)-3H-diazirin-3-yl]benzyl bromide "anchor" molecule of the formula

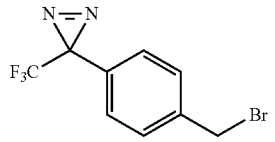

having a first terminus including a trifluoromethyl diazirine group as a carbene precursor and a second terminus including a benzyl bromide group, in the presence of ultraviolet radiation to form a textile surface bound to the first terminus of the bifunctional diazirene "anchor" molecule; and reacting the textile bound to the first terminus of the bifunctional diazirene "anchor" molecule with a dye molecule that covalently binds the second terminus of the bifunctional diazirene "anchor" molecule.

In another embodiment, a method of dyeing textiles including surface functionalization of para-aramids (e.g., Kevlar®) with a carbene-based molecule is provided. The method includes reacting the para-aramid (e.g., Kevlar®) textile fabric of the formula

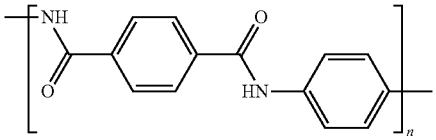

with the bifunctional diazirene 4-[3-(Trifluoromethyl)-3H-diazirin-3-yl]benzyl bromide "anchor" molecule of the formula

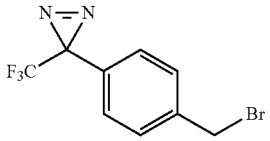

having a first terminus including a trifluoromethyl diazirine group as a carbene precursor group and a second terminus including a benzyl bromide group, in the presence of ultraviolet radiation to form a Kevlar® textile fabric bound to the first terminus of the bifunctional diazirene 4-[3-(Trifluoromethyl)-3H-diazirin-3-yl]benzyl bromide "anchor" molecule to form a compound of the formula

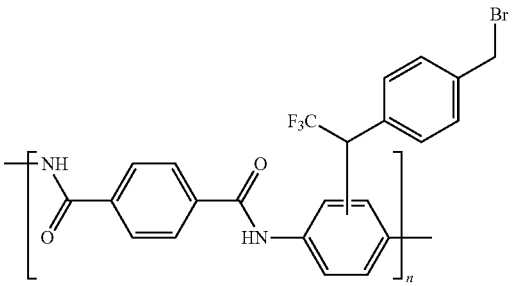

reacting the Kevlar® textile fabric bound to the first terminus of the bifunctional diazirene 4-[3-(Trifluoromethyl)-3H-diazirin-3-yl]benzyl bromide "anchor" molecule with a dye molecule of the formula

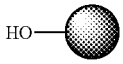

in the presence of base to form dye bound to the second terminus of the bifunctional diazirene 4-[3-(Trifluoromethyl)-3H-diazirin-3-yl]benzyl bromide "anchor" molecule of the Kevlar® textile fabric to form a compound of the formula

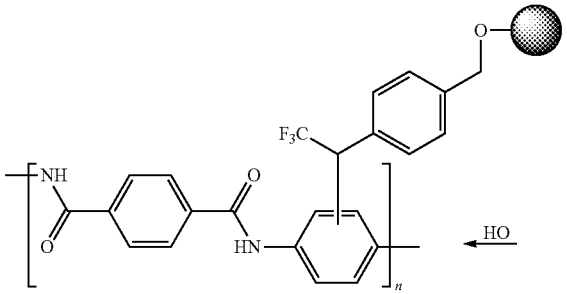

In another embodiment, a method of dyeing textiles including a para-aramid via surface functionalization of para-aramid with a carbene-based molecule is provided. The method includes performing an Appel bromination reaction of 4-[3-(Trifluoromethyl)-3H-diazirin-3-yl]benzyl alcohol 202 using carbon tetrabromide, dry dichloromethane and triphenylphosphine to form a bifunctional diazirene 4-[3-(Trifluoromethyl)-3H-diazirin-3-yl]benzyl bromide "anchor" molecule of the formula

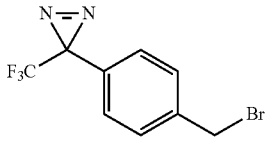

reacting the para-aramid of the textile with a compound of the formula

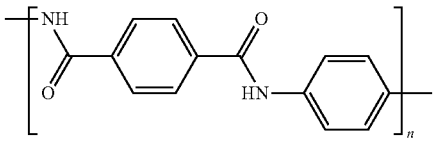

with the bifunctional diazirene 4-[3-(Trifluoromethyl)-3H-diazirin-3-yl]benzyl bromide "anchor" molecule of the formula

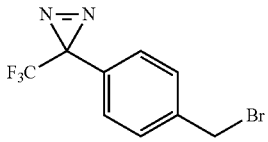

having a first terminus including a trifluoromethyl diazirine group as a carbene precursor and a second terminus including a benzyl bromide group, in the presence of ultraviolet radiation to form a para-aramid fabric bound to the first terminus of the bifunctional diazirene 4-[3-(Trifluoromethyl)-3H-diazirin-3-yl]benzyl bromide "anchor" molecule of the formula

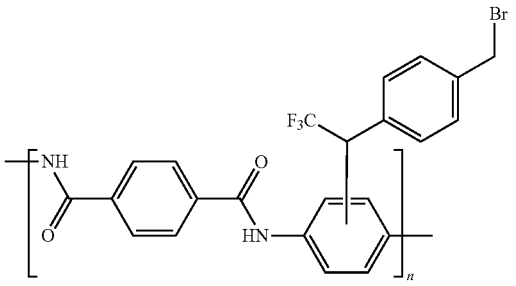

reacting the para-aramid surface bound to the first terminus of the bifunctional diazirene 4-[3-(Trifluoromethyl)-3H-diazirin-3-yl]benzyl bromide "anchor" molecule with a dye molecule of the formula

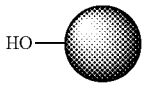

in the presence of base to form dye bound to the second terminus of the bifunctional diazirene 4-[3-(Trifluoromethyl)-3H-diazirin-3-yl]benzyl bromide "anchor" molecule on the para-aramid of the formula

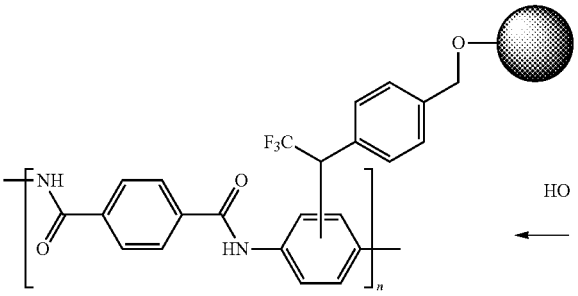

DETAILED DESCRIPTION

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by embodiments of the present disclosure. As used herein, "about" may be understood by persons of ordinary skill in the art and can vary to some extent depending upon the context in which it is used. If there are uses of the term which are not clear to persons of ordinary skill in the art, given the context in which it is used, "about" may mean up to plus or minus 10% of the particular term.

Para-aramids, UHMWPE, and nylon include synthetic polymers or co-polymers that are transformed through various industrial fiber and fabric processing technologies into filaments, fibers, fabrics, and textiles with common trade names such as Kevlar®, Twaron®, Spectra®, Dyneema®, and Cordura. Textiles comprising these materials can be implemented for use in various military and law enforcement applications, including tactical gear to protect personnel from ballistics, blasts, and other similar threats, such as personal body armor, bulletproof vests, helmets, ballistic face masks, and protective undergarments.

The chemical basis of Kevlar is typically the para-aramid (a.k.a. aromatic polyamide) polymer called poly(p-phenylene terephthalamide (abbreviated PPTA), which is converted to Kevlar through industrial fiber and fabric processing methods. In addition to having exceptional tensile strength (particularly tensile strength-to-weight ratio), Young's modulus, and stability toward thermal or mechanical degradation, Kevlar also has a strong backbone of amide bonds, efficient interchain hydrogen-bonding interactions, a high degree of crystallinity, and a lack of reactive functional groups, each of which contribute to Kevlar's chemical resistance toward most chemical agents and dye molecules applied through conventional methods. Traditional non-covalent dyes wash off Kevlar readily, reactive dyes do not have sufficient electrophilic or nucleophilic sites to react and form chemical bonds, and Kevlar does not form strong intermolecular interactions with small-molecule adsorbents due to the involvement of the amide N—H groups in the hydrogen bonding networks. Aromatic copolyamides (made of co-polymers) are another class of para-aramid with similar mechanical properties and high resistance to heat and chemicals as Kevlar. Some aromatic copolyamides have some advantages in terms of solvent use and processability (Kiriyama, U.S. Pat. No. 5,177,175). UHMWPE is processed into fibers and other structures through gel-spinning and drawing, and UHMWPE fibers have widespread uses in the fields of composite reinforcements and soft armor. UHMWPE is also chemically inert due to its hydrocarbon structure and shows resistance to dyeing and the application of coatings.

The chemical inertness of para-aramids and UHMWPE makes high-performance textiles constructed from their fibers and/or yarns resistant to dyeing/printing by conventional processes and a challenge to implement in some protective outerwear applications, particularly those that require multi-colored camouflage patterns suitable for different operational environments.

Alternative dyeing methods exist that circumvent or overcome the chemical resistance of para-aramids and UHMWPE fibers and fabrics, such as solution dyeing, pad dyeing, or the use of swelling agents. Typically, these methods produce fabrics dyed in a limited number of solid colors and monochromatic hues, and these methods are therefore not suitable for producing camouflage patterns. Additionally, these alternative dye methods require the use of strong acids, harsh solvents, chemical additives, or other chemicals. The uses of these chemicals raise practical and environmental concerns regarding the safe treatment of dye effluent waste streams.

Other methods can use reactive carbenes to dye the para-aramid Kevlar®, UHMWPE, and nylon via surface functionalization. Specifically, aryl and diarylcarbenes have been used as reactive intermediates to functionalize powders, sheets, fibers, or fabrics of textile-related polymeric substrates, such as cotton (fabric, fiber), nylon-610 (sheet), UHMWPE (powder), and Kevlar® (fabric). These methods have limitations based on their implementation of chemical synthesis strategies that use lengthy treatment times (>18 h) that are untenable for scale-up and manufacturing processes, and that use hazardous chemicals, such as toxic mercury compounds, that are unsafe for human health and the environment. Additionally, the reagents used in the present disclosure are thermally stable. In other methods, the reagents used are temperature-sensitive materials, that can degrade non-specifically during storage or during functionalization procedures, and lower the efficiency of dye attachment to the polymer. Novel/print methods are needed to produce high-performance textiles that are multi-colored with specific shades and patterns, and that include filaments or fibers of para-aramids (polymers or co-polymers), UHMWPE, nylon, and their blends for increased protection from ballistics and blast-related threats, while reducing the use of chemicals and dyestuffs that are hazardous to human health and the environment.

Aspects of the present disclosure are a novel chemical process for dyeing para-aramids or UHMWPE, which are difficult to dye with conventional dyeing methods. The primary application is protective outerwear, particularly those that need to be dyed/printed in camouflage shades and patterns, such as combat uniform fabrics designed to enhance extremity protection in buried blast events occurring in different operational environments (e.g., roadside, urban, sub-terrancan).

Aspects of the present disclosure are also a process of using carbenes, a class of reactive compounds known to bind inert organic polymers, to covalently dye high performance textiles that include para-aramid, UHMWPE, or nylon filament yarns or spun yarn fibers or fiber-blends for protective outerwear that can also increase protection from ballistics and blast-related threats. A carbene molecule contains a neutral carbon atom with a valence of two and two unshared valence electrons that can have either singlet or triplet electronic structure. The fabrics being dyed include multi-filament Kevlar® (typical para-aramid) yarns, Spectra (UHMWPE) multi-filament yarns, Cordura (ballistics nylon) filament yarns, and spun yarns with these fibers or as fiber-blends. The methods of the present disclosure avoid the use of concentrated battery acid, swelling agents, MERCURY, or other toxic chemicals that are hazardous to human health and the environment.

Aspects of the present disclosure also are a bifunctional diazirene reagent for dyeing protective fabrics including high-performance textiles comprising para-aramid (e.g., Kevlar®), UHMWPE, nylon filament yarns or spun yarns made of fibers or fiber blends thereof via surface functionalization, and whose chemical reaction processes do not compromise the strength or material properties of the treated filaments, fibers or fabrics, take substantially less time (<2 h), and eliminate the use of toxic mercury resulting in a method that is faster and more environmentally-friendly than methods disclosed in prior art. As a bifunctional structure (FIG. 1), the diazirene reagent features, on its first terminus, a trifluoromethyl diazirine group as a carbene precursor, and a benzyl bromide group on the second terminus as a site for substitution reactions. This diazirene reagent was used to functionalize and dye a range of fabrics used in ballistics textiles, including those made from para-aramid (Kevlar®), UHMWPE, or nylon filaments or spun yarns, including fiber blends thereof (FIGS. 2-6). The resulting coloration was found to be robust and colorfast with respect to water, solvent, and simulated laundering. The diazirene-carbene precursor is also more stable than a diazo-carbene precursor and is not prone to uncontrolled decomposition, such as that observed with diazo compounds and that can limit their effectiveness.

This carbene-based method provides a general, mild strategy for the covalent attachment of small molecules to inert polymers and has several potential advantages. First, the diazirine reagent used herein is liquid at ambient temperature and miscible with most organic solvents, which facilitates convenient application to fabrics and textiles. Second, the diazirene reagent is readily prepared on gram-scale as a bench-stable liquid. Third, the diazirene reagent is rapidly activated by long-wavelength UV light (375 nm) or heat to produce the corresponding reactive carbene intermediate with the release of a dinitrogen molecule. Fourth, the trifluoromethyl carbene can insert directly into C—H bonds. Fifth, this diazirene treatment does not compromise the structural integrity or mechanical strength of the substrate being treated (e.g., the textile being dyed). Overall, this method has the potential to dye ballistics textiles that comprise para-aramids (Kevlar®), UHMWPE, nylon, or spun yarns of fiber blends thereof for their potential use in a broader range of protective outerwear applications, including those requiring multi-colored, patterned protective outerwear in operationally-relevant shades of green, brown, tan, black, etc.

Aspects of the present disclosure include the brominated (Br) precursor (e.g., 4-[3-(Trifluoromethyl)-3H-diazirin-3-yl]benzyl bromide).

One embodiment of the present disclosure includes preparation of the bifunctional diazirene reagent (e.g., 4-[3-(Trifluoromethyl)-3H-diazirin-3-yl]benzyl bromide) 100, as illustrated in FIG. 1. Specifically, the bifunctional diazirene reagent (e.g., 4-[3-(Trifluoromethyl)-3H-diazirin-3-yl]benzyl bromide) 100 can be made, for example, by an Appel bromination reaction of 4-[3-(Trifluoromethyl)-3H-diazirin-3-yl]benzyl alcohol 102 using carbon tetrabromide 104, dry dichloromethane 106 and triphenylphosphine 108. The resultant bifunctional reagent 100 has a diazirene group at one terminus (indicated as the first terminus throughout for clarity), and bromide at the second terminus.

Aspects of the present disclosure include a method for dyeing fabrics comprising para-aramid (Kevlar®), UHMWPE (Spectra), nylon (Cordura) filament yarns or spun yarns of these fibers or fiber blends comprising para-aramid, UHMWPE, and nylon, particularly with environmentally friendly technologies, as an important strategy for developing next-generation protective gear, possibly in multi-color patterns of shades of green, brown, tan, and black typical of camouflage to address specific threats and situations. In these embodiments, a bifunctional, small-molecule halogenated carbene precursor is photoactivated (FIG. 2) to react efficiently with otherwise inert polymeric materials and provide covalently-attached electrophilic sites for the attachment of various dyes.

Figure 2:
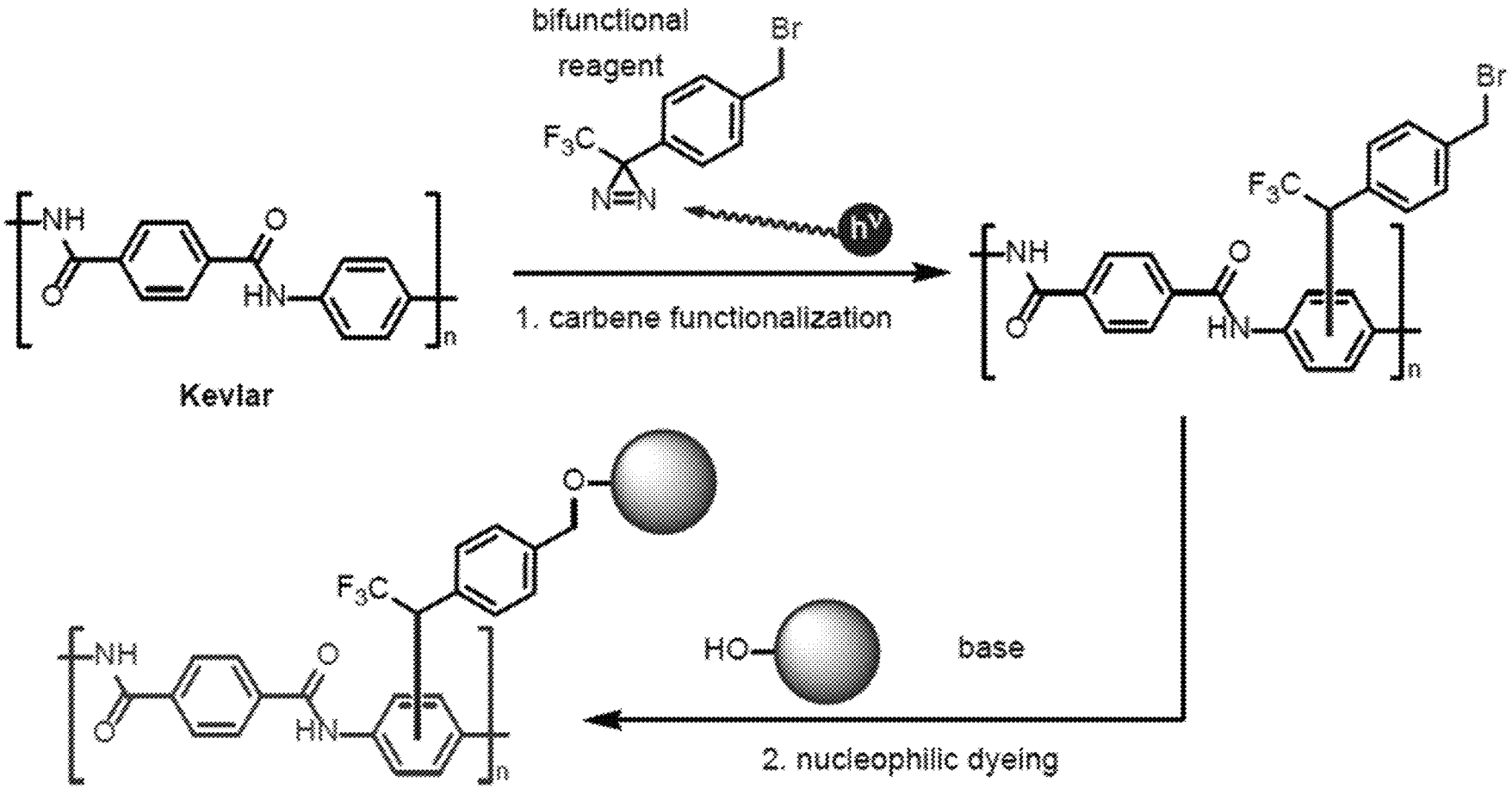
FIG. 2 illustrates one embodiment of the present disclosure schematically designating the process for covalently binding dye molecules to a Kevlar® textile substrate through the bifunctional "anchor" molecule.

The embodiments illustrated in FIG. 2 include a general scheme for dyeing fabrics made from fibers and yarns derived from inert polymeric materials. In this illustrative example of this embodiment, the para-aramid fabric made from Kevlar® 200 reacts with a bifunctional diazirene (e.g., 4-[3-(Trifluoromethyl)-3H-diazirin-3-yl]benzyl bromide) 202 in the presence of long-wavelength UV light, that can be in the range of about 320 to about 400 nm, about 370-375 nm 204 at a distance that can be in the range from about 1 to about 15 cm and about 5 cm from the treated surface for a period that can range from about 10 to about 60 minutes, about 30 minutes (carried out twice, once on each side of the fabric sample being treated), resulting in the Kevlar® surface functionalized by covalent bonding with one terminus of the bifunctional diazirene through C—H insertion with the aromatic groups of Kevlar®, such that the bifunctional diazirene acts an "anchor" molecule 206.

Aspects of the current disclosure include substituting the para-aramid fabric made from Kevlar® 200 with fabrics made from UHMWPE, or nylon filament yarns or spun yarns of these fibers, including fiber blends (FIG. 6), to achieve similar functionalized surfaces with one terminus of the bifunctional diazirene reagent 202 covalently bonded.

The functionalized Kevlar® 206 is reacted with the dye 208 in the presence of base, which results in the dye binding to the second terminus of the bifunctional diazirene reagent of the functionalized Kevlar® 210 by binding dye molecules to the site of the Bromine (—Br) leaving group. This dyeing process can be carried out with multiple dye types. Aspects of the current disclosure use dyes that can include but are not limited to, acridine yellow G, solvent yellow 7, oil red O, 1,4-diamino anthraquinone, Texas red cadaverine, napthazarin, quinizarin, pyridium dyes, or toluidine blue O. A multitude of synthetic and designed dyes are possible and need only contain a group capable of displacing the bromide leaving group.

Figure 6:
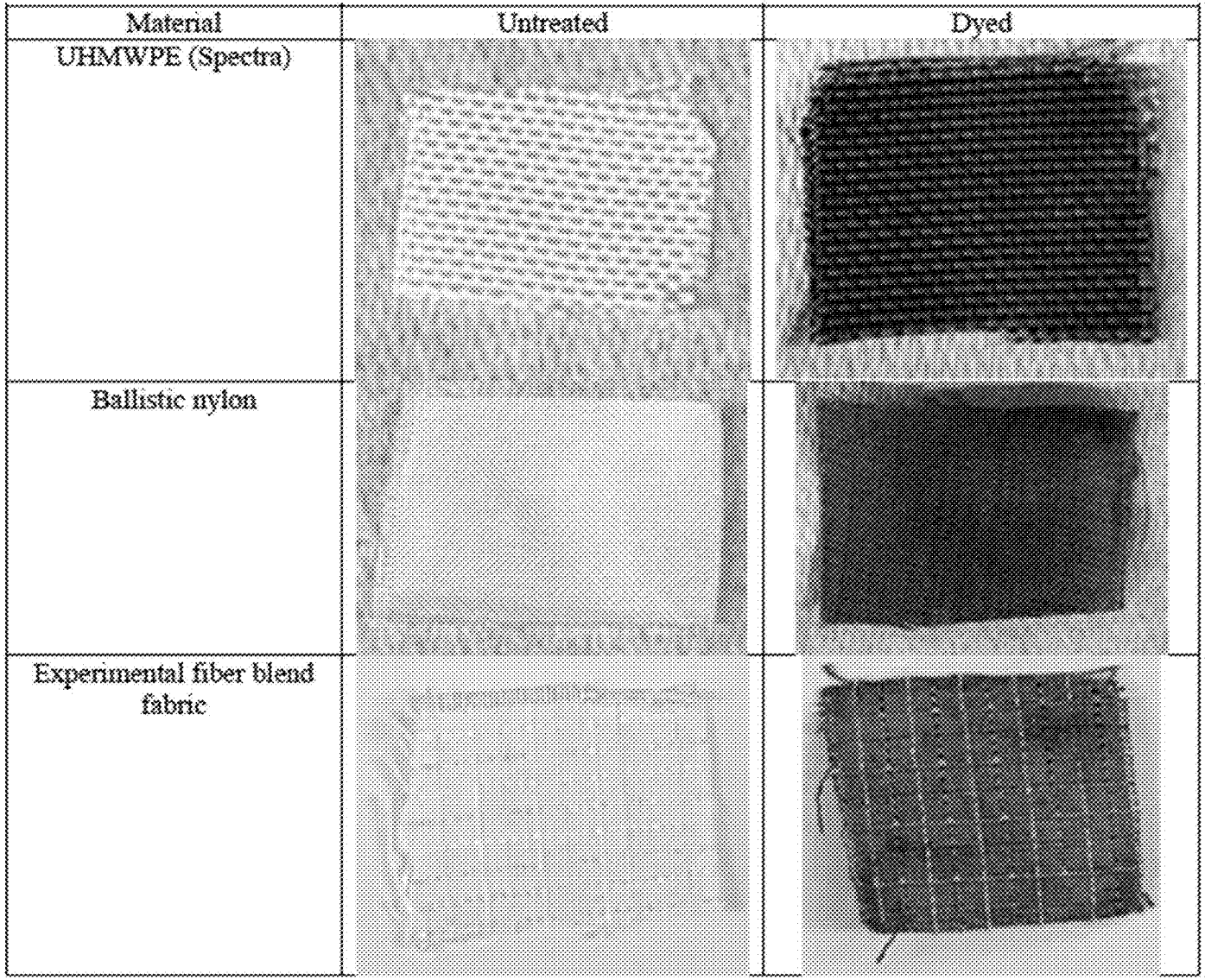
FIG. 6. illustrates examples of additional fabrics dyed through diazirene functionalization, followed by thermal treatment with Quinizarin and DBU include, in descending order: UHMWPE (Spectra 955), nylon (Cordura), and spun yarns of fiber blends that include para-aramid, UHMWPE, and nylon.

Aspects of the present disclosure include reacting the surface of the functionalized material, exemplified by Kevlar® (206 in FIG. 2), but could also be UHMWPE or nylon filament yarns or spun yarns, including fiber blends thereof, with a suitable dyestuff (FIG. 6).

Figure 3:
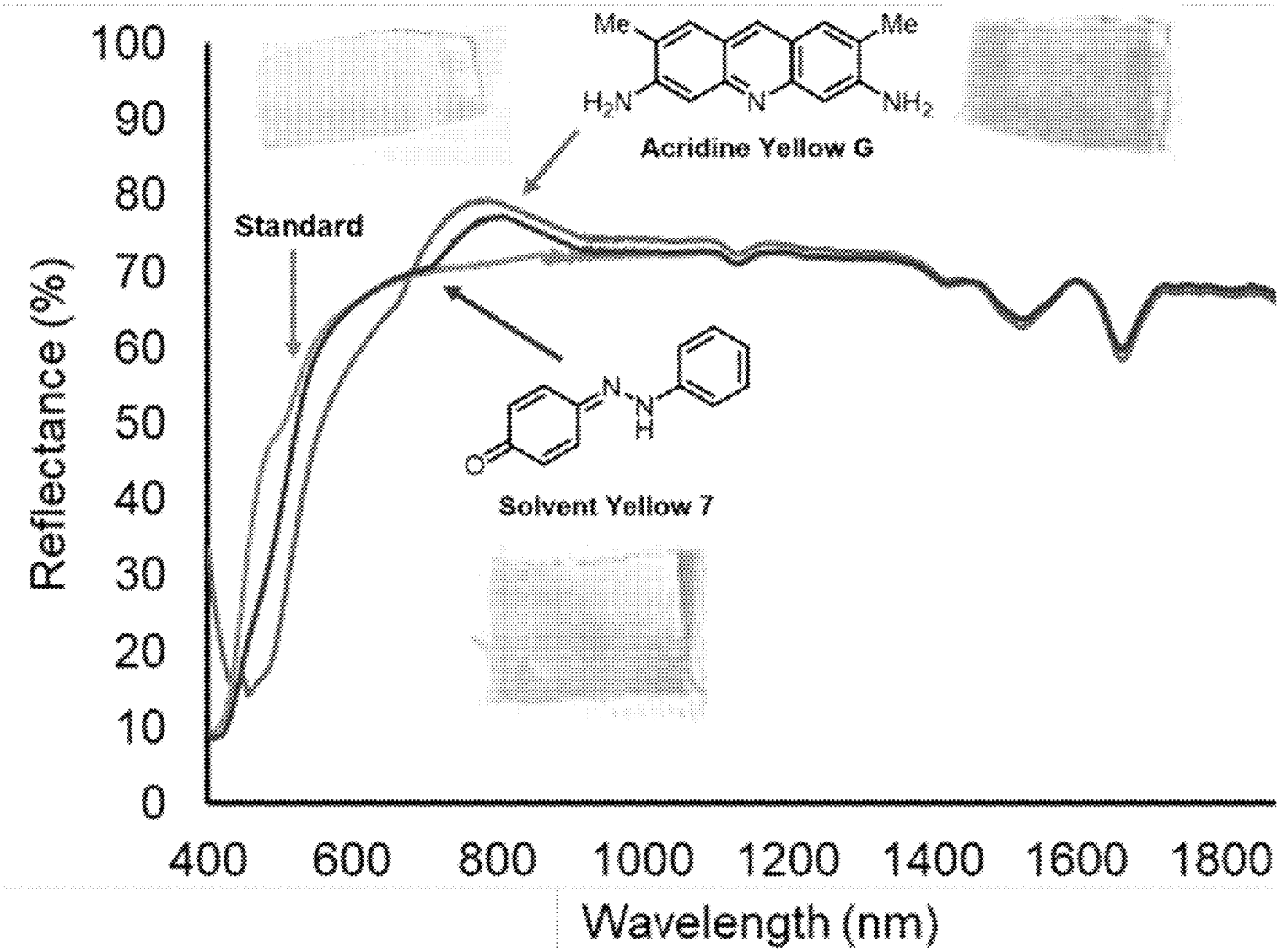
FIG. 3 is a graphical representation of % Reflectance versus wavelength of undyed Kevlar® fabric (standard) and Kevlar® fabric dyed with Acridine Yellow G dye, and Kevlar® fabric dyed with Solvent Yellow 7 dye.

FIG. 3 illustrates a graphical representation of % Reflectance versus wavelength of undyed Kevlar® fabric (standard) 300 and Kevlar® fabric dyed with acridine yellow G dye 302, and Kevlar® fabric dyed with Solvent yellow 7 dye 304.

Figure 4:
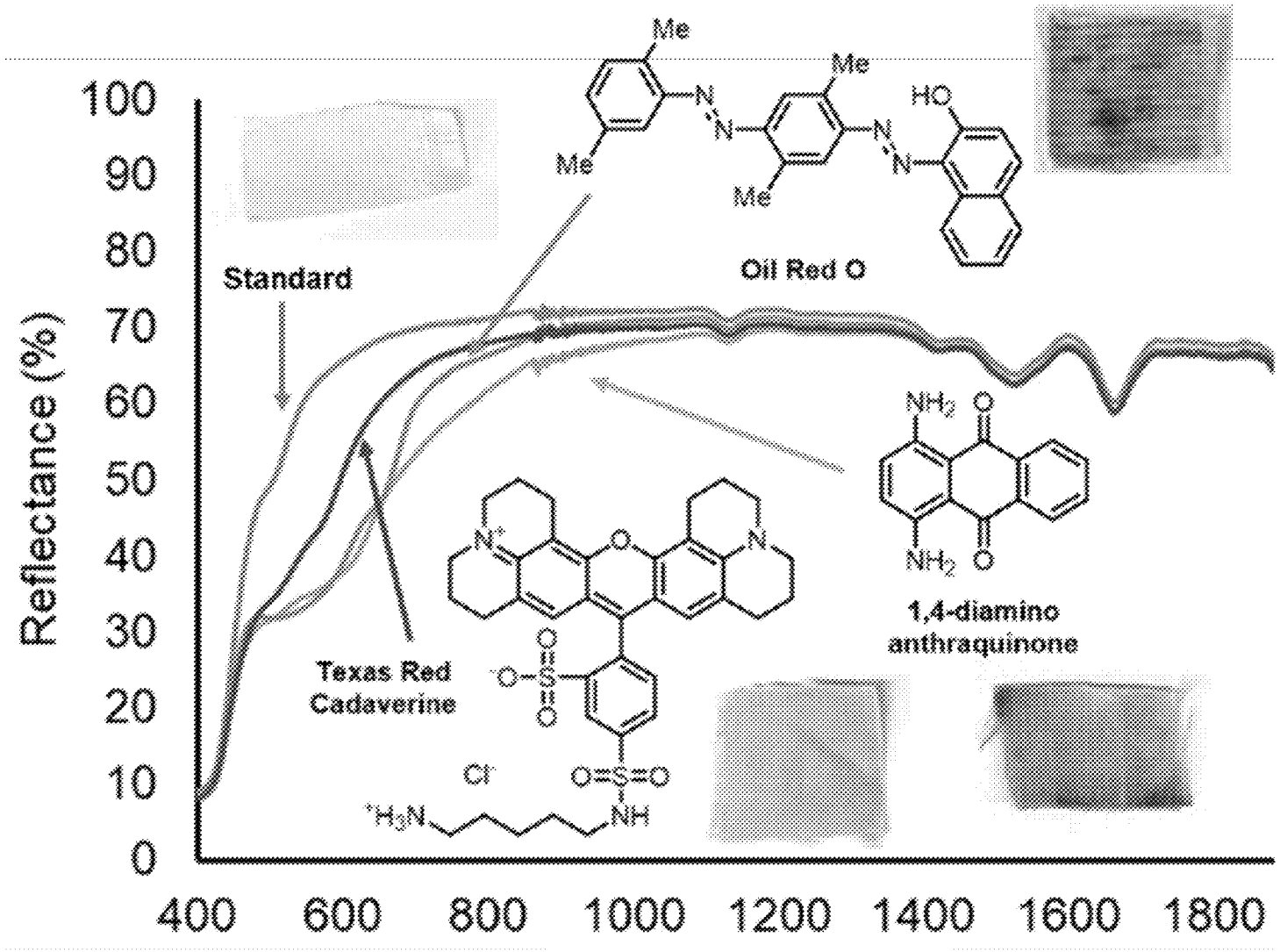
FIG. 4 is a graphical representation of % Reflectance versus wavelength of undyed Kevlar® fabric (standard) and Kevlar® fabric dyed with Oil Red O dye, Kevlar® fabric dyed with 1,4-diamino anthraquinone dye, and Kevlar® fabric dyed with Texas Red Cadaverine dye.

FIG. 4 illustrates a graphical representation of % Reflectance versus wavelength of undyed Kevlar® fabric (standard) 400 and Kevlar fabric dyed with oil red O 402, Kevlar® fabric dyed with 1,4-diamino anthraquinone 404, and Kevlar® fabric dyed with Texas red cadaverine 406.

Figure 5:
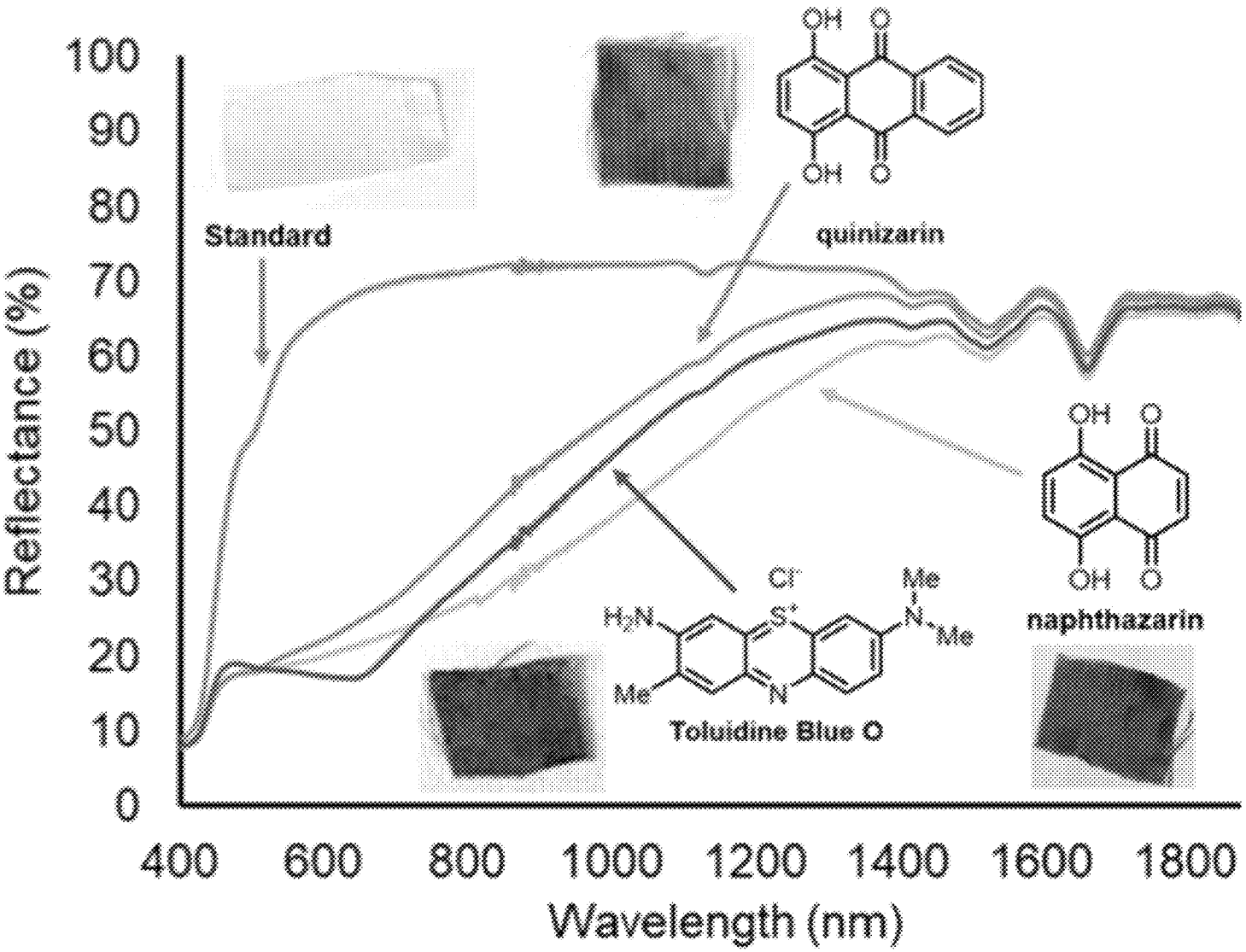
FIG. 5 is a graphical representation of % rRflectance versus wavelength of undyed Kevlar® fabric (standard) and Kevlar® fabric dyed with Quinizarin dye, Kevlar fabric dyed with Napthazarin dye, and Kevlar® fabric dyed with Toluidine Blue O dye.

FIG. 5 illustrates a graphical representation of % Reflectance versus wavelength of undyed Kevlar® fabric (standard) 500 and Kevlar® fabric dyed with napthazarin 502, quinizarin 504, and toluidine blue O 506.

FIG. 6. Illustrates examples of additional fabrics dyed through diazirene functionalization and subsequent thermal treatment with Quinizarin and DBU include: UHMWPE (Spectra 955) 600, nylon (Cordura) 602, and fabrics made of spun yarns of fiber blends 603.

Example 1

The synthesis of the bifunctional diazirene reagent (4-[3-(Trifluoromethyl)-3H-diazirin-3-yl]benzyl bromide) as the bifunctional carbene precursor molecule shown in FIG. 1, 4-[3-(Trifluoromethyl)-3H-diazirin-3-yl]benzyl alcohol is used as the starting material. Specifically, the bifunctional diazirene (e.g., 4-[3-(Trifluoromethyl)-3H-diazirin-3-yl]benzyl bromide) was made by the Appel bromination reaction that was carried out in a 50 mL round-bottomed flask that was dried in an oven and cooled under dry nitrogen. Carbon tetrabromide 200 (1.68 g, 5.06 mmol, 1.1 equiv) and dry dichloromethane 202 (10 mL) were combined in the flask, than a magnetic stir bar was added, and the flask was capped with a rubber septum. Using a needle connected to vacuum manifold, the flask was quickly evacuated, then refilled with nitrogen. This procedure was repeated a total of three times. While the solution was stirring rapidly, a solution of triphenylphosphine (1.33 g, 5.06 mmol, 1.1 equiv) in dichloromethane (10 mL) was added dropwise by syringe. After 30 min, the bifunctional diazirene (e.g. 4-[3-(Trifluoromethyl)-3H-diazirin-3-yl]benzyl alcohol) was added in one portion, and the reaction mixture is left to stir at room temperature (T≈20-22° C. for 12 h. At this point, the septum was removed, and the solvent was distilled away with the aid of a rotary evaporator. The crude residue was subjected to flash column chromatography using a gradient of hexanes to 1:5 ethyl acetate/hexanes as cluent. The bifunctional diazirene product (e.g., 4-[3-(Trifluoromethyl)-3H-diazirin-3-yl]benzyl bromide) was obtained as a colorless oil (1.19 g, 93% yield), confirmed via spectroscopy, and stored in the dark in a conventional refrigerator.

Example 2

To apply the brominated bifunctional diazirine (4-[3-(Trifluoromethyl)-3H-diazirin-3-yl]benzyl bromide) to the fabrics made of para-aramid, UHMWPE, nylon, or spun yarns of fiber blends thereof, a roughly 2 cm×2 cm fabric sample was cleaned thoroughly by rinsing with water, acetone, and dichloromethane, followed by drying in a 50° C. oven for 20 min. The sample was then placed into a glass Petri dish inside a well-ventilated chemical fume hood, and a solution of 4-[3-(Trifluoromethyl)-3H-diazirin-3-yl]benzyl bromide (10 mg/mL in Dichloromethane) was added dropwise to the fabric to saturate the fibers. After about 1 mL of the solution was added, the fabric was turned over and the procedure was repeated, then the Petri dish and fabric was placed inside a 50° C. oven for 5 min to evaporate the dichloromethane. The fabric was then removed and irradiated for 30 min on each side with a handheld long-wavelength UV lamp (370 nm) held at a distance of about 5 cm. The sample was placed into a 20 mL scintillation vial, which was then filled with dichloromethane and submerged in an ultrasonication bath for about 30 seconds. The solvent was decanted away, and this washing procedure was repeated for a total of 4 times, followed by an additional wash with acetone. After air drying, samples were analyzed by X-ray photoelectron spectroscopy to assess incorporation of the diazirine-derived fragments.

Example 3

To dye fabrics made of para-aramid, UHMWPE, or nylon filament yarns or spun yarns, including fiber-blends, thereof, a fabric sample of prepared according to the treatment of Example 2, was immediately placed in a dry Petri dish. A solution of dye (5.0 mg) and minimal dichloromethane, acetone, or acetonitrile (1.0 mL or less) was combined in a 20 mL scintillation vial. A volume (0.050 mL) of the strong organic base 1,8-Diazabicyclo[5.4.0]undec-7-ene (DBU) was added, and the mixture was stirred or subjected to sonication until fully homogeneous. This dye mixture was then added dropwise to the fabric sample, allowing for several minutes of evaporation in a well-ventilated fume hood in between applications. The Petri dish containing the fabric was then placed into a pre-heated oven at T=120° C. for 10 min. After cooling to room temperature, the sample was placed into a 20 mL scintillation vial, which was then filled with dichloromethane and submerged in an ultrasonication bath for about 30 seconds. The solvent was decanted away, 6 and this washing procedure was repeated with acetone, methanol, and water. After drying in air, photographs and total diffuse reflectance spectra were obtained (see FIGS. 3-5).

This written description uses examples as part of the disclosure, including the best mode, and also to enable any person skilled in the art to practice the disclosed implementations, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While there have been shown, described and pointed out, fundamental features of the present disclosure as applied to the exemplary embodiments thereof, it will be understood that various omissions and substitutions and changes in the form and details of compositions, devices and methods illustrated, and in their operation, may be made by those skilled in the art without departing from the spirit or scope of the present disclosure. Moreover, it is expressly intended that all combinations of those elements and/or method steps, which perform substantially the same function in substantially the same way to achieve the same results, are within the scope of the present disclosure. Moreover, it should be recognized that structures and/or elements and/or method steps shown and/or described in connection with any disclosed form or embodiment of the present disclosure may be incorporated in any other disclosed or described or suggested form or embodiment as a general matter of design choice. It is the intention, therefore, to be limited only as indicated by the scope of the claims appended hereto.

The term "about" as used herein means greater or lesser than the value or range of values stated by 10 percent, but is not intended to designate any value or range of values to only this broader definition. Each value or range of values preceded by the term "about" is also intended to encompass the embodiment of the stated absolute value or range of values.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

Unless otherwise defined, all technical and scientific terms used herein have the same meaning as commonly understood by one of ordinary skill in the art to which this invention belongs. The terminology used in the description of the invention herein is for the purpose of describing particular embodiments only and is not intended to be limiting of the invention.

Unless indicated otherwise, explicitly or by context, the following terms are used herein as set forth below.

As used in the description of the invention and the appended claims, the singular forms "a," "an" and "the" are intended to include the plural forms as well, unless the context clearly indicates otherwise.

Also as used herein, "and/or" refers to and encompasses any and all possible combinations of one or more of the associated listed items, as well as the lack of combinations when interpreted in the alternative ("or").

Components and features described herein may be combined in any desired manner to achieve the desired performance goals.

What is claimed is:

1. A method of dyeing textiles including surface functionalization with a carbene-based molecule, comprising:

reacting the textile with a bifunctional diazirene reagent 4-[3-(Trifluoromethyl)-3H-diazirin-3-yl]benzyl bromide "anchor" molecule of the formula

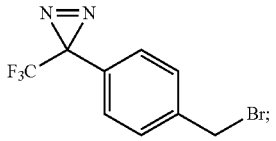

having a first terminus including a trifluoromethyl diazirine group as a carbene precursor and a second terminus including a benzyl bromide group, in the presence of ultraviolet radiation to form a textile surface bound to the first terminus of the bifunctional diazirene "anchor" molecule;

and reacting the textile bound to the first terminus of the bifunctional diazirene "anchor" molecule with a dye molecule that covalently binds the second terminus of the bifunctional diazirene "anchor" molecule.

2. The method of claim 1, wherein the textiles include fabrics made of yarns comprising para-aramid, Ultra High Molecular Weight Polyethylene (UHMWPE), nylon, or blends therof.

3. The method of claim 2, wherein the fabrics include filament or spun yarns.

4. The method of claim 3, wherein the para-aramid yarns comprise aromatic polyamides or aromatic copolyamides.

5. The method of claim 4, wherein the para-aramid yarns comprise the aromatic polyamide poly(p-phenylene terephthalamide).

6. The method of claim 1, wherein the dye molecule is nucleophilic and includes acridine yellow G, solvent yellow 7, oil red O, 1,4-diamino anthraquinone, texas red cadaverine, quinizarin, or toluidine blue O.

7. The method of claim 1, wherein the ultraviolet radiation can be long-wavelength ultraviolet light in the range of about 320 to about 400 nm or about 370-375 nm, held at a distance that can be in the range from about 1 to about 15 cm from the treated surface, and for a period that can range from about 10 to about 60 minutes and carried out twice, once on each side of the fabric sample being treated.

8. A method of dyeing textiles including surface functionalization of a textile fabric comprising Kevlar yarns with a carbene-based molecule, comprising:

reacting the textile fabric comprising poly(p-phenylene terephthalamide yarns with the bifunctional diazirene 4-[3-(Trifluoromethyl)-3H-diazirin-3-yl]benzyl bromide "anchor" molecule of the formula

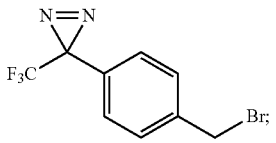

having a first terminus including a trifluoromethyl diazirine group as a carbene precursor group and a second terminus including a benzyl bromide group, in the presence of ultraviolet radiation to form a textile fabric comprising poly(p-phenylene terephthalamide yarns bound to the first terminus of the bifunctional diazirene 4-[3-(Trifluoromethyl)-3H-diazirin-3-yl]benzyl bromide "anchor" molecule to form a compound of the formula

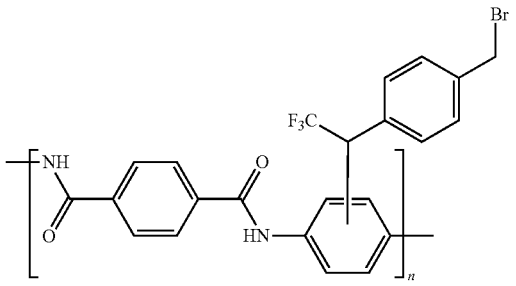

reacting the textile fabric comprising poly(p-phenylene terephthalamide yarns bound to the first terminus of the bifunctional diazirene 4-[3-(Trifluoromethyl)-3H-diazirin-3-yl]benzyl bromide with an "anchor" molecule with a dye molecule of the formula

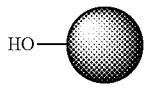

in the presence of base to form dye bound to the second terminus of the bifunctional diazirene 4-[3-(Trifluoromethyl)-3H-diazirin-3-yl]benzyl bromide "anchor" molecule of the textile fabric comprising poly(p-phenylene terephthalamide yarns to form a compound of the formula

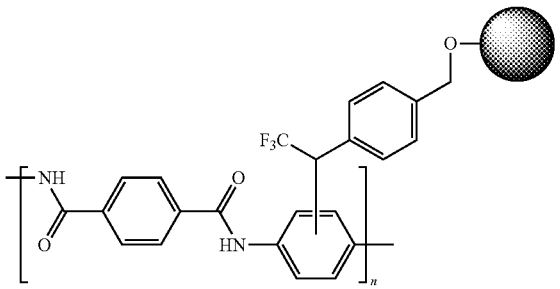

9. The method of claim 8, wherein the fabrics include filament or spun yarns.

10. The method of claim 8, wherein the dye molecule is nucleophilic and includes acridine yellow G, solvent yellow 7, oil red O, 1,4-diamino anthraquinone, Texas red cadaverine, quinizarin, or toluidine blue O.

11. The method of claim 8, wherein the ultraviolet radiation includes long-wavelength ultraviolet light that can be in the range of about 320 to about 400 nm or about 370-375nm, held at a distance that can be in the range from about 1 to about 15 cm from the treated surface, and for a period that can range from about 10 to about 60minutes and carried out twice, once on each side of the fabric sample being treated.

12. A method of dyeing textiles including a para-aramid via surface functionalization of para-aramid with a carbene-based molecule, comprising:

performing an Appel bromination reaction of 4-[3-(Trifluoromethyl)-3H-diazirin-3-yl]benzyl alcohol using carbon tetrabromide, dry dichloromethane and triphenylphosphine to form a bifunctional diazirene 4-[3-(Trifluoromethyl)-3H-diazirin-3-yl]benzyl bromide "anchor" molecule of the formula

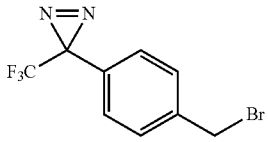

reacting the para-aramid of the textile of the formula

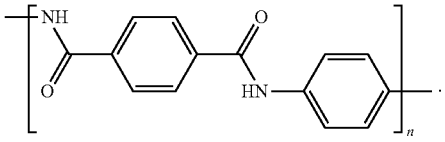

with the bifunctional diazirene 4-[3-(Trifluoromethyl)-3H-diazirin-3-yl]benzyl bromide "anchor" molecule of the formula

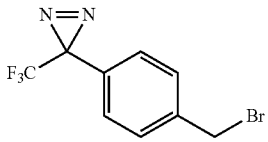

having a first terminus including a trifluoromethyl diazirine group as a carbene precursor group and a second terminus including a benzyl bromide group, in the presence of ultraviolet radiation to form a para-aramid fabric bound to the first terminus of the bifunctional diazirene 4-[3-(Trifluoromethyl)-3H-diazirin-3-yl]benzyl bromide an "anchor" molecule of the formula

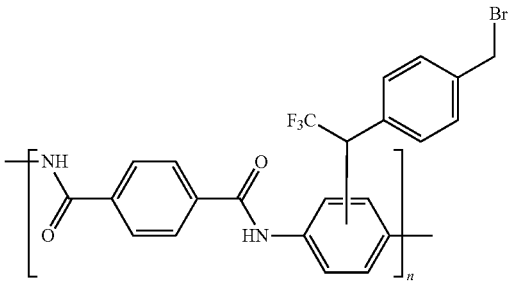

reacting the para-aramid surface bound to the first terminus of the bifunctional diazirene 4-[3-(Trifluoromethyl)-3H-diazirin-3-yl]benzyl bromide an "anchor" molecule with a dye molecule of the formula

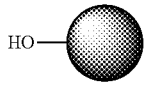

in the presence of base to form dye bound to the second terminus of the bifunctional diazirene 4-[3-(Trifluoromethyl)-3H-diazirin-3-yl]benzyl bromide an "anchor" molecule on the para-aramid of the formula

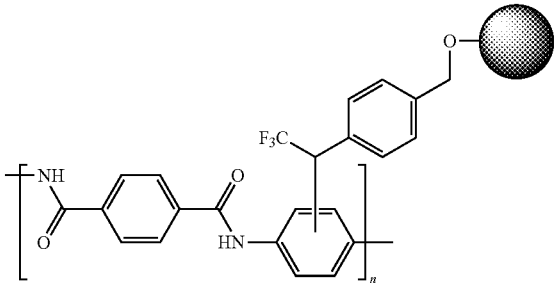

13. The method of claim 12, wherein the fabrics include filament or spun yarns.

14. The method of claim 12, wherein the dye molecule is nucleophilic and includes acridine yellow G, solvent yellow 7, oil red O, 1,4-diamino anthraquinone, Texas red cadaverine, quinizarin, or toluidine blue O.

15. The method of claim 12, wherein the ultraviolet radiation can be long-wavelength ultraviolet light in the range of about 320 to about 400 nm or about 370-375 nm, held at a distance that can be in the range from about 1 to about 15 cm from the treated surface, and for a period that can range from about 10 to about 60 minutes and carried out twice, once on each side of the fabric sample being treated.

* * * * *